US009919357B2

(12) United States Patent
Sugiura et al.

(10) Patent No.: US 9,919,357 B2
(45) Date of Patent: Mar. 20, 2018

(54) UP-DRAWING CONTINUOUS CASTING APPARATUS AND UP-DRAWING CONTINUOUS CASTING METHOD

(71) Applicant: TOYOTA JIDOSHA KABUSHIKI KAISHA, Toyota-shi, Aichi-ken (JP)

(72) Inventors: Naoaki Sugiura, Takahama (JP); Yusuke Yokota, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/123,440

(22) PCT Filed: Mar. 5, 2015

(86) PCT No.: PCT/IB2015/000353

§ 371 (c)(1),
(2) Date: Sep. 2, 2016

(87) PCT Pub. No.: WO2015/136363

PCT Pub. Date: Sep. 17, 2015

(65) Prior Publication Data

US 2017/0066046 A1 Mar. 9, 2017

(30) Foreign Application Priority Data

Mar. 10, 2014 (JP) ..... 2014-046044

(51) Int. Cl.
*B22D 11/14* (2006.01)
*B22D 11/041* (2006.01)

(52) U.S. Cl.
CPC ..... *B22D 11/145* (2013.01); *B22D 11/041* (2013.01)

(58) Field of Classification Search
CPC ..... B22D 11/041; B22D 11/145; B22D 11/01; B22D 11/14; B22D 11/141
See application file for complete search history.

(56) References Cited

U.S. PATENT DOCUMENTS 6,217,803 B1 4/2001 Uozumi
2013/0171021 A1 7/2013 Yaokawa et al.

FOREIGN PATENT DOCUMENTS

CN 1213992 A 4/1999
JP 63-199050 A 8/1988
JP 09-248657 A 9/1997
JP 2012-061518 A 3/2012

*Primary Examiner* — Kevin P Kerns
*Assistant Examiner* — Steven S Ha
(74) *Attorney, Agent, or Firm* — Oliff PLC

(57) ABSTRACT

An up-drawing continuous casting method casts a casting having a bent portion. When an angle (θ) (where, 0°≤θ≤90°) between an up-drawing direction of molten metal and an upper surface of a shape determining member is reduced to a first angle, drawing up the molten metal while maintaining the angle (θ) at the first angle, and casting a first casting, and casting a connecting portion adjacent to the cast first casting; interrupting the drawing up of the molten metal, and dipping the connecting portion into the molten metal while passing the connecting portion through the shape determining member, and melting the connecting portion; and setting the angle (θ) to a second angle that is larger than the first angle, restarting the drawing up of the molten metal and casting a second casting adjacent to the first casting.

4 Claims, 9 Drawing Sheets

UP-DRAWING CONTINUOUS CASTING APPARATUS AND UP-DRAWING CONTINUOUS CASTING METHOD

BACKGROUND OF THE INVENTION

1. Field of the Invention

The invention relates to an up-drawing continuous casting apparatus and an up-drawing continuous casting method.

2. Description of Related Art

Japanese Patent Application Publication No. 2012-61518 (JP 2012-61518 A) proposes a free casting method as a groundbreaking up-drawing continuous casting method that does not require a mold. As described in JP 2012-61518 A, a starter is first dipped into the surface of molten metal (i.e., a molten metal surface), and then when the starter is drawn up, molten metal is also drawn up following the starter by surface tension and the surface film of the molten metal. Here, a casting that has a desired sectional shape is able to be continuously cast by drawing up the molten metal through a shape determining member arranged near the molten metal surface, and cooling the drawn up molten metal.

With a normal continuous casting method, the sectional shape and the shape in the longitudinal direction are both determined by a mold. In particular, with a continuous casting method, the solidified metal (i.e., the casting) must pass through the mold, so the cast casting takes on a shape that extends linearly in the longitudinal direction. In contrast, the shape determining member in the free casting method determines only the sectional shape of the casting. The shape in the longitudinal direction is not determined. Therefore, castings of various shapes in the longitudinal direction are able to be obtained by drawing the starter up while moving the starter (or the shape determining member) in a horizontal direction. For example, JP 2012-61518 A describes a hollow casting (i.e., a pipe) formed in a zigzag shape or a helical shape, not a linear shape in the longitudinal direction.

The inventors discovered the problem described below. With the free casting method described in JP 2012-61518 A, molten metal is drawn up through the shape determining member, so a solidification interface is positioned higher than the shape determining member. Therefore, the molten metal is able to be drawn up diagonally instead of vertically, by drawing up the starter while moving the starter (or the shape determining member) in the horizontal direction.

However, if an up-drawing angle θ (i.e., an angle between the molten metal surface and the up-drawing direction; ($0° < \theta \leq 90°$) is too small, the molten metal that has been drawn up through the shape determining member will end up being offset with respect to the upper surface of the shape determining member, such that the sectional shape of the casting will no longer be able to be controlled. Therefore, a casting in which the up-drawing angle θ of the molten metal is too small was unable to be formed. That is, with the free casting method described in JP 2012-61518 A, the shape in which a casting can be formed may be limited.

SUMMARY OF THE INVENTION

The invention thus provides an up-drawing continuous casting apparatus and an up-drawing continuous casting method capable of reducing a limitation on the shape in which a casting can be formed.

A first aspect of the invention relates to an up-drawing continuous casting method that makes it possible to cast a casting having a bent portion, by drawing up molten metal held in a holding furnace while passing the molten metal through a shape determining member that determines a sectional shape of the cast casting. This method involves, when an angle between an up-drawing direction of the molten metal and an upper surface of the shape determining member, the angle between the up-drawing direction of the molten metal and the upper surface of the shape determining member being within a range from 0° to 90°, is reduced to a first angle, drawing up the molten metal while maintaining the angle between the up-drawing direction of the molten metal and the upper surface of the shape determining member at the first angle, and casting a first casting, and then casting a connecting portion adjacent to the cast first casting; interrupting the drawing up of the molten metal, and dipping the connecting portion into the molten metal while passing the connecting portion through the shape determining member, and melting the connecting portion; and setting the angle between the up-drawing direction of the molten metal and the upper surface of the shape determining member to a second angle that is larger than the first angle, restarting the drawing up of the molten metal and casting a second casting adjacent to the first casting. According to this kind of method, a casting that is unable to be formed with the up-drawing continuous casting method according to the related art is able to be formed. That is, the limitation on the shape of the casting able to be formed is able to be reduced.

The connecting portion may be separated from the molten metal when the drawing up of the molten metal is interrupted. According to this kind of method, the first casting and the connecting portion are able to be rotated easily. Also, the first angle may be greater than 30°. According to this kind of method, an offset between the molten metal that has been drawn up through the shape determining member, and the upper surface of the shape determining member, is able to be prevented, so the dimensional accuracy of the casting is able to be improved. Furthermore, when dipping the connecting portion into the molten metal, the connecting portion is dipped into the molten metal with a longitudinal direction of the connecting portion being aligned with a direction perpendicular to a molten metal surface of the molten metal. According to this kind of method, it is easier to dip the connecting portion into the molten metal to restart the drawing up of the molten metal.

A second aspect of the invention relates to an up-drawing continuous casting apparatus that includes a holding furnace that holds molten metal; a shape determining member that is arranged above a molten metal surface of the molten metal held in the holding furnace, and determines a sectional shape of a cast casting by the molten metal passing through the shape determining member; and an up-drawing machine that fixes a starter with a chuck portion, and draws up the molten metal via the starter. The chuck portion is configured to be able to change a chucking angle by rotating the starter while the starter is in a chucked state. According to this kind of structure, a casting that is unable to be formed with the up-drawing continuous casting apparatus according to the related art is able to be formed. That is, the limitation on the shape of the casting able to be formed is able to be reduced.

The invention thus makes it possible to provide an up-drawing continuous casting apparatus and an up-drawing continuous casting method capable of reducing a limitation on the shape in which a casting can be formed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, specific example embodiments to which the invention has been applied will be described in detail with reference to the accompanying drawings. However, the invention is not limited to these example embodiments. Also, the description and the drawings are simplified as appropriate for clarity.

First Example Embodiment

Figure 1:
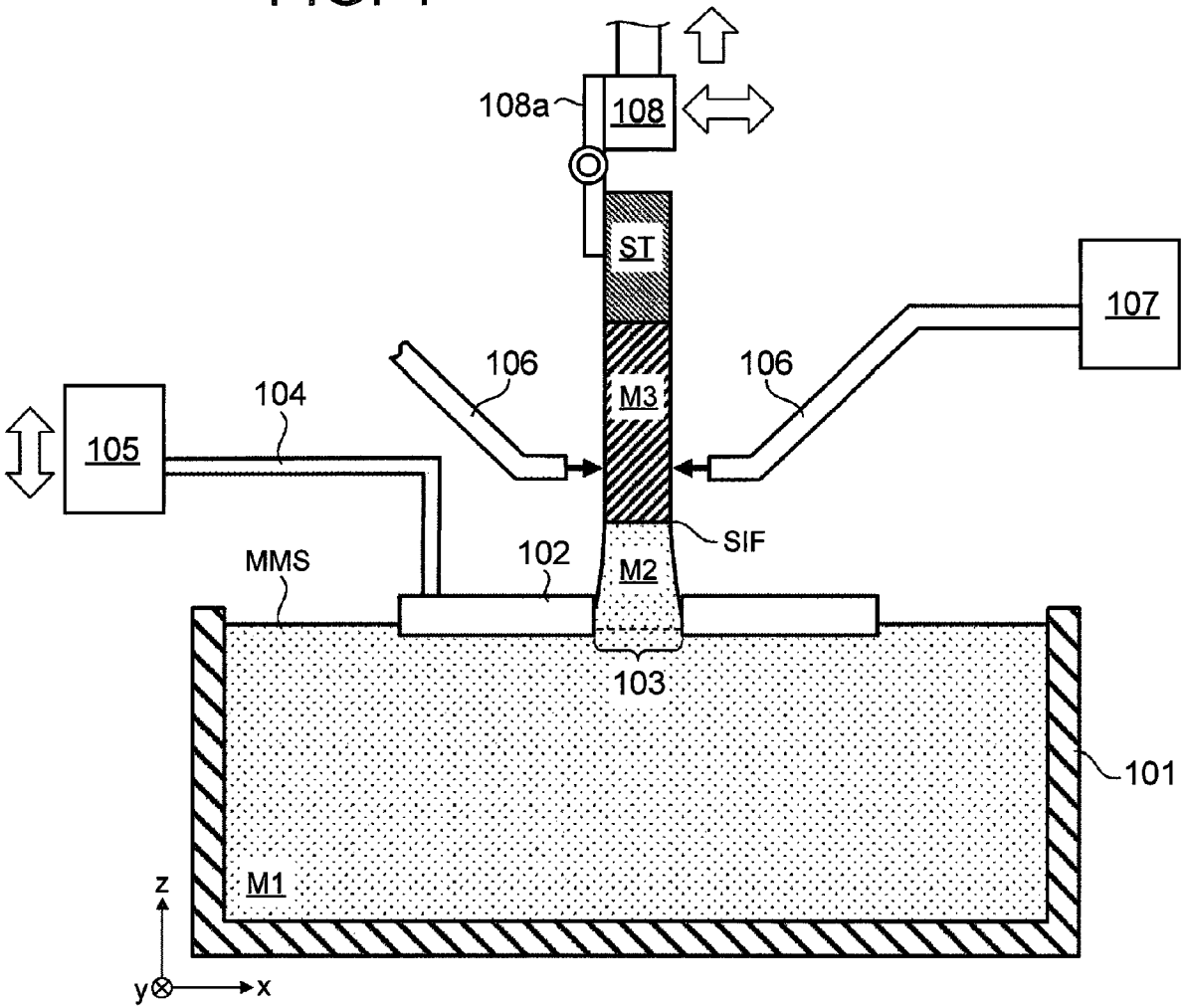
FIG. 1 is a sectional view showing a frame format of a free casting apparatus according to a first example embodiment of the invention.

First, a free casting apparatus (up-drawing continuous casting apparatus) according to a first example embodiment of the invention will be described with reference to FIG. 1. FIG. 1 is a sectional view showing a frame format of the free casting apparatus according to the first example embodiment. As shown in FIG. 1, the free casting apparatus according to the first example embodiment includes a molten metal holding furnace 101, a shape determining member 102, a support rod 104, an actuator 105, a cooling gas nozzle 106, a cooling gas supplying portion 107, and an up-drawing machine 108. Naturally, a right-handed xyz coordinate system shown in FIG. 1 is for descriptive purposes in order to illustrate the positional relationship of the constituent elements. The x-y plane in FIG. 1 forms a horizontal plane, and the z-axis direction is the vertical direction. More specifically, the plus direction of the z-axis is vertically upward.

The molten metal holding furnace 101 holds molten metal M1 such as aluminum or an aluminum alloy, for example, and keeps it at a predetermined temperature at which the molten metal M1 has fluidity. In the example in FIG. 1, molten metal is not replenished into the molten metal holding furnace 101 during casting, so the surface of the molten metal M1 (i.e., a molten metal surface MMS level) drops as casting proceeds. However, molten metal may also be replenished into the molten metal holding furnace 101 when necessary during casting so that the molten metal surface MMS level is kept constant. Here, the position of a solidification interface SIF can be raised by increasing a set temperature of the molten metal holding furnace 101, and lowered by reducing the set temperature of the molten metal holding furnace 101. Naturally, the molten metal M1 may be another metal or alloy other than aluminum.

The shape determining member 102 is made of ceramic or stainless steel, for example, and is arranged above the molten metal surface MMS. The shape determining member 102 determines the sectional shape of a cast casting M3. The casting M3 shown in FIG. 1 is a solid casting (a plate) having a rectangular cross-section in the horizontal direction (hereinafter, simply referred to as "transverse section"). Naturally, the sectional shape of the casting M3 is not particularly limited. The casting M3 may also be a hollow casting of a round pipe or a square pipe or the like.

In the example in FIG. 1, a main surface (a lower surface) on a lower side of the shape determining member 102 is arranged contacting the molten metal surface MMS. Therefore, an oxide film that forms on the molten metal surface MMS and foreign matter floating on the molten metal surface MMS are able to be prevented from getting mixed into the casting M3. However, the lower surface of the shape determining member 102 may also be arranged a predetermined distance away from the molten metal surface MMS. When the shape determining member 102 is arranged away from the molten metal surface MMS, heat deformation and erosion of the shape determining member 102 are inhibited, so the durability of the shape determining member 102 improves.

Figure 2:
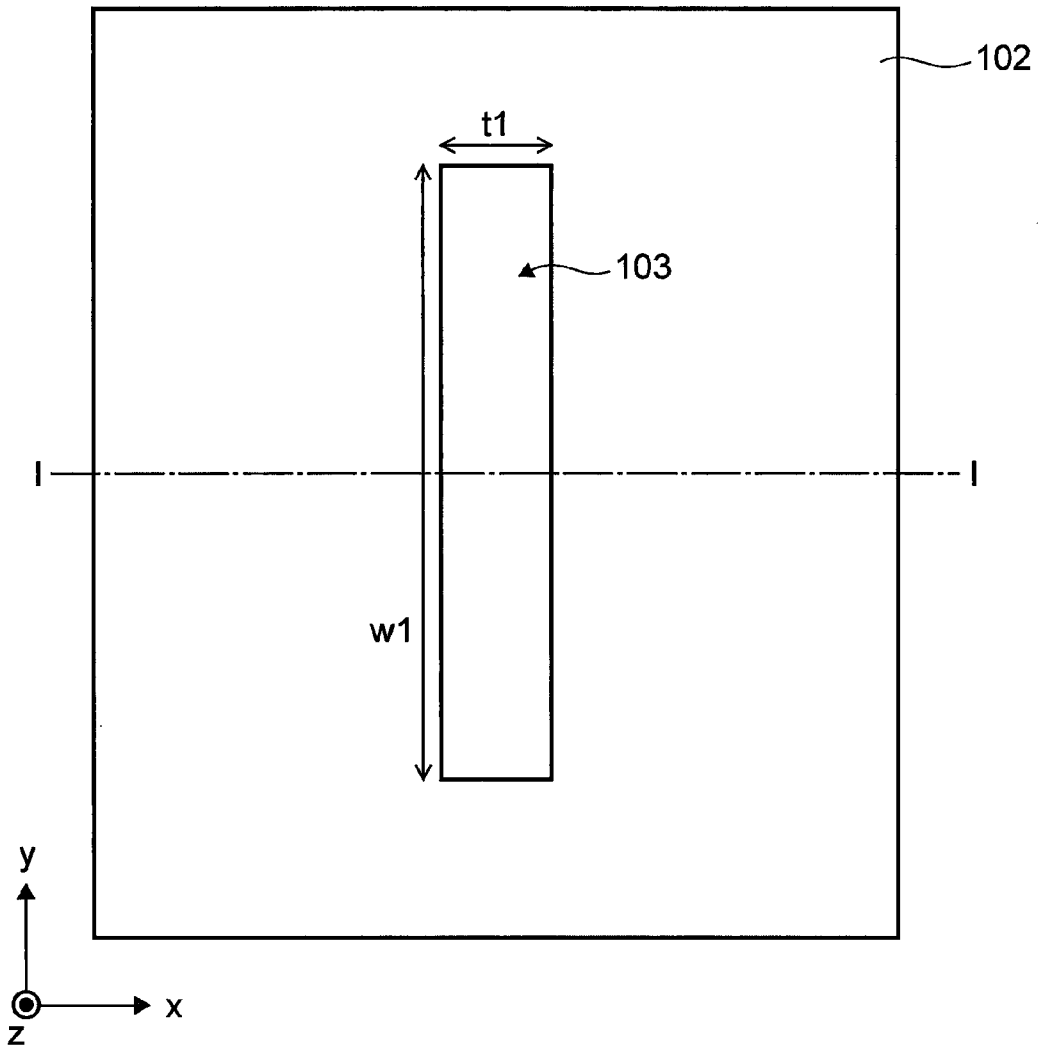
FIG. 2 is a plan view of a shape determining member according to the first example embodiment.

FIG. 2 is a plan view of the shape determining member 102 according to the first example embodiment. Here, the sectional view of the shape determining member 102 in FIG. 1 corresponds to a sectional view taken along line I-I in FIG. 2. As shown in FIG. 2, the shape determining member 102 has a rectangular planar shape, for example, and has a rectangular open portion (a molten metal passage portion 103) having a thickness t1 and a width w1 through which the molten metal passes in the center portion. The xyz coordinates in FIG. 2 match those in FIG. 1.

As shown in FIG. 1, the molten metal M1 is drawn up following the casting M3 by the surface tension and the surface film of the molten metal M1, and passes through the molten metal passage portion 103 of the shape determining member 102. That is, by passing the molten metal M1 through the molten metal passage portion 103 of the shape determining member 102, external force is applied to the molten metal M1 from the shape determining member 102, such that the sectional shape of the casting M3 is determined. Here, the molten metal that is drawn up from the molten metal surface MMS following the casting M3 by the surface tension and surface film of the molten metal will be referred to as "retained molten metal M2". Also, the boundary between the casting M3 and the retained molten metal M2 is a solidification interface SIF.

The support rod 104 supports the shape determining member 102. The support rod 104 is connected to the actuator 105. The shape determining member 102 is able to move up and down (i.e., in the vertical direction, i.e., the z-axis direction) via the support rod 104, by the actuator 105. According to this kind of structure, the shape determining member 102 is able to be moved downward as the molten metal surface MMS level drops as casting proceeds.

The cooling gas nozzle (a cooling portion) 106 is cooling means for spraying cooling gas (e.g., air, nitrogen, argon, or the like) supplied from the cooling gas supplying portion 107 at the casting M3 to indirectly cool the retained molten metal M2. The position of the solidification interface SIF is able to be lowered by increasing the flow rate of the cooling gas, and raised by reducing the flow rate of the cooling gas. The cooling gas nozzle 106 is also able to be moved up and down (i.e., in the vertical direction, i.e., in the z-axis direction) and horizontally (i.e., in the x-axis direction and the y-axis direction). Therefore, for example, the cooling gas nozzle 106 can be moved downward, in concert with the movement of the shape determining member 102, as the molten metal surface MMS level drops as casting proceeds. Alternatively, the cooling gas nozzle 106 can be moved horizontally, in concert with horizontal movement of the up-drawing machine 108.

The casting M3 is cooled by the cooling gas while being drawn up by the up-drawing machine 108 that is connected to the starter ST via a chuck portion 108*a*. Therefore, the casting M3 is formed by the retained molten metal M2 near the solidification interface SIF progressively solidifying from the upper side (i.e., a plus side in the z-axis direction) toward lower side (i.e., a minus side in the z-axis direction). The position of the solidification interface SIF is able to be raised by increasing the up-drawing speed with the up-drawing machine 108, and lowered by reducing the up-drawing speed.

Also, the retained molten metal M2 is able to be drawn up diagonally by drawing the retained molten metal M2 up while moving the up-drawing machine 108 horizontally (in the x-axis direction and the y-axis direction). Therefore, the longitudinal shape of the casting M3 is able to be freely changed. The longitudinal shape of the casting M3 may also be freely changed by moving the shape determining member 102 horizontally, instead of by moving the up-drawing machine 108 horizontally.

Here, the chuck portion 108*a* has a hinge structure in which a pair of plate-like members are rotatably connected together by a pin extending in the y-axis direction. Therefore, the angle for chucking the starter ST (i.e., the chucking angle) is able to be changed. One of the plate-like members is fixed to a main body of the up-drawing machine 108, and the other plate-like member is fixed to the starter ST. Therefore, the starter ST is able to be rotated about an axis that is parallel to the molten metal surface MMS (the y-axis in the example in FIG. 1). Here, the angle between the pair of plate-like members is able to be both changed and fixed. That is, after the angle between the pair of plate-like members is changed, it is fixed at that angle and used.

In this way, the chuck portion 108*a* is able to change the chucking angle by rotating the starter ST, while the starter ST is being chucked. Therefore, there is no need to re-chuck in order to change the chucking angle, which is advantageous for productivity of the casting. The chuck portion 108*a* is not limited to the hinge structure, as long as the structure enables the chucked starter ST to be rotated about an axis that is parallel to the molten metal surface MMS (i.e., the y-axis in the example in FIG. 1).

Figure 3:
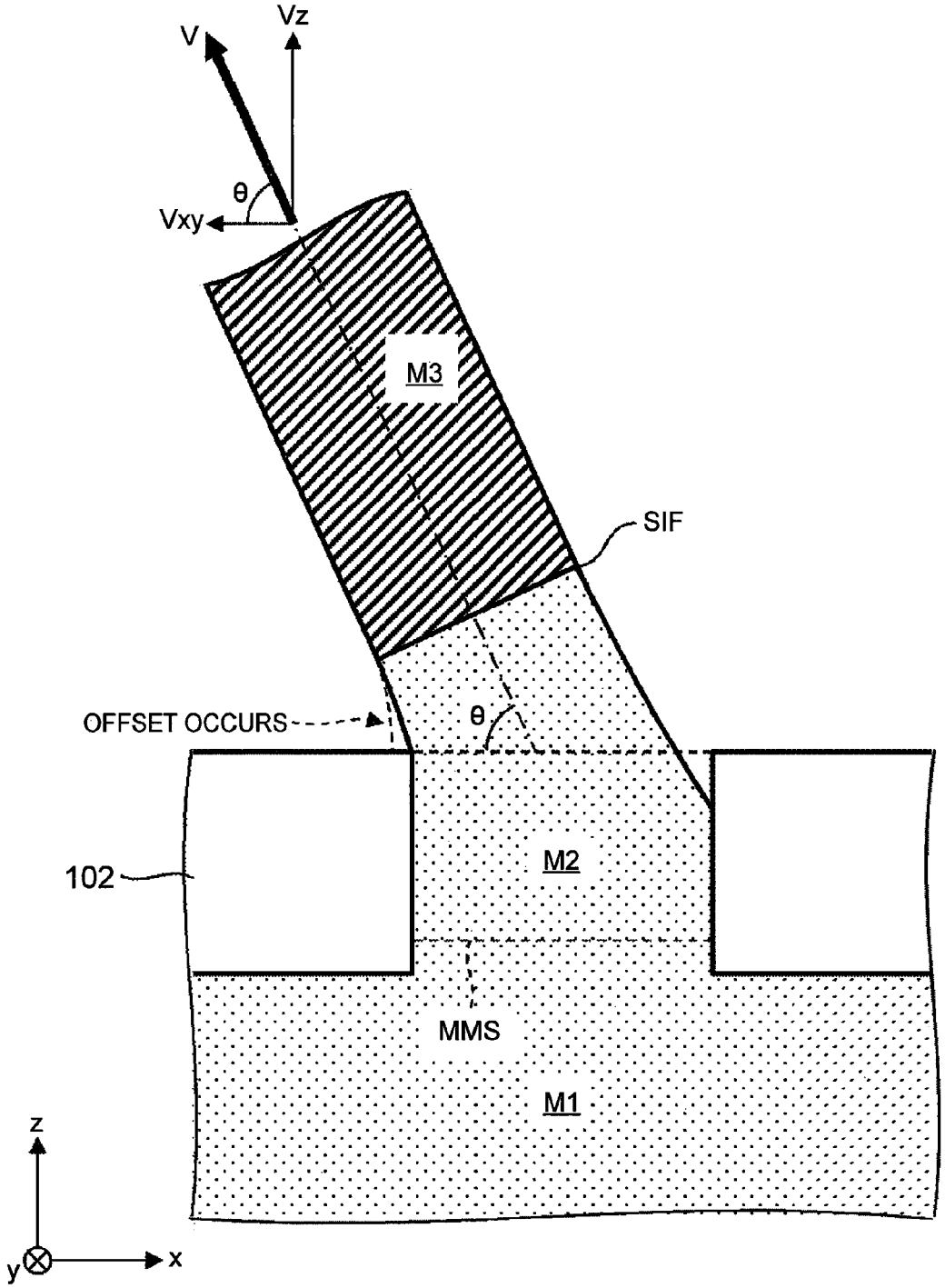
FIG. 3 is an enlarged sectional view showing a frame format of a case in which molten metal is drawn up diagonally.

Here, a case in which the molten metal is drawn up diagonally will be described with reference to FIG. 3. FIG. 3 is an enlarged sectional view showing a frame format of a case in which the molten metal is drawn up diagonally. The xyz coordinates in FIG. 3 also match those in FIG. 1.

As shown in FIG. 3, the angle between the molten metal surface MMS and the up-drawing direction (i.e., the direction of the up-drawing speed V) is an up-drawing angle $0° < \theta \leq 90°$). Here, this up-drawing angle θ is also an angle between an upper surface (the main surface on the upper side) of the shape determining member 102, and the up-drawing direction. The up-drawing speed V and the up-drawing angle θ are determined from an up-drawing speed Vz in the vertical direction by the up-drawing machine 108, and a moving speed Vxy in the horizontal direction. In the example in FIG. 3, the up-drawing machine 108 moves only in the x-axis direction, and does not move in the y-axis direction. Also, as shown in FIG. 3, it is confirmed through testing that the solidification interface SIF is substantially perpendicular to the up-drawing direction.

As shown by the broken line in FIG. 3, when the up-drawing angle θ is reduced, the retained molten metal M2 that has passed through the shape determining member 102 ends up being offset with respect to the upper surface of the shape determining member 102, such that the sectional shape of the casting M3 is no longer able to be controlled. In the test, when the up-drawing angle θ was 30° or less, an offset occurred between the retained molten metal M2 and the upper surface of the shape determining member 102. However, when the up-drawing angle θ was 45° or greater, no offset occurred between the retained molten metal M2 and the upper surface of the shape determining member 102. Therefore, a casting in which the up-drawing angle θ of the molten metal is 30° or less is unable to be formed. That is, with the free casting apparatus of the related art, there is a limit to the shape in which a casting can be formed.

In contrast, with the free casting apparatus according to the first example embodiment, the chucking angle of the starter ST is able to be changed by the chuck portion 108*a* of the up-drawing machine 108, just as described above. Therefore, with the free casting apparatus according to the first example embodiment, casting is temporarily stopped if the up-drawing angle θ decreases to a predetermined reference angle (a first angle) at which no offset occurs. The reference angle is preferably greater than 30°. As a result, offset is able to be prevented, so dimensional accuracy of the casting is able to be improved. Also, when restarting casting, the chucking angle of the starter ST is changed so that the molten metal is initially drawn up in the vertical direction. Then, casting is restarted while maintaining this chucking angle. Moreover, if the up-drawing angle θ decreases to the predetermined reference angle, the series of operations described above is repeated. Therefore, with the free casting apparatus according to the first example embodiment, it is possible to form a casting that was unable to be formed with the free casting apparatus of the related art.

Next, a free casting method according to the first example embodiment will be described with reference to FIGS. 4 to 8. FIGS. 4 to 8 are sectional views showing frame formats illustrating the free casting method according to the first example embodiment. Here, a case in which a casting with a longitudinal cross-section bent in a general L-shape (i.e., with a bending angle of approximately 90°) is cast will be described. This kind of casting is unable to be formed with the free casting apparatus of the related art.

Figure 4:
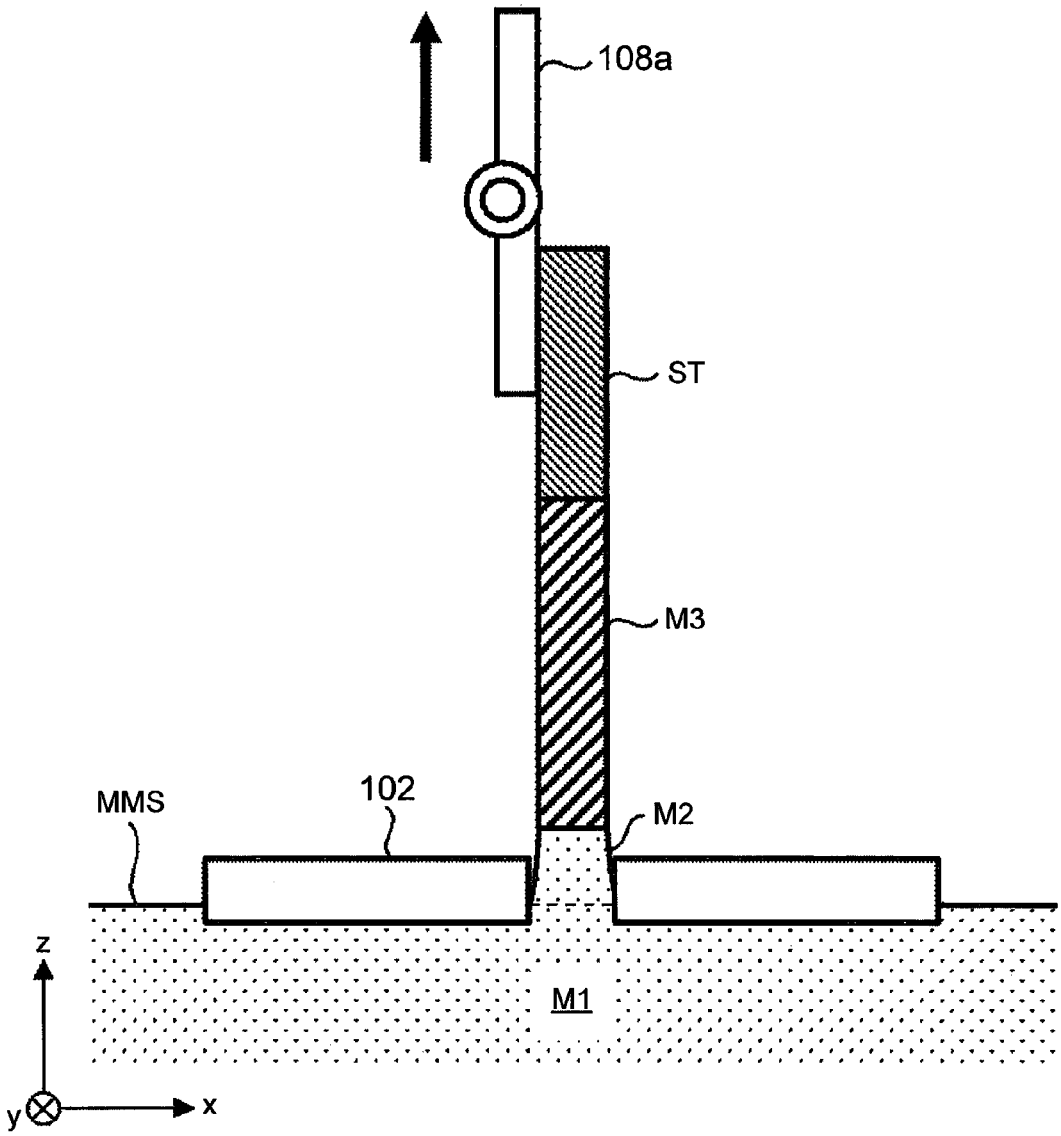
FIG. 4 is a sectional view showing a frame format illustrating a free casting method according to the first example embodiment.
Figure 5:
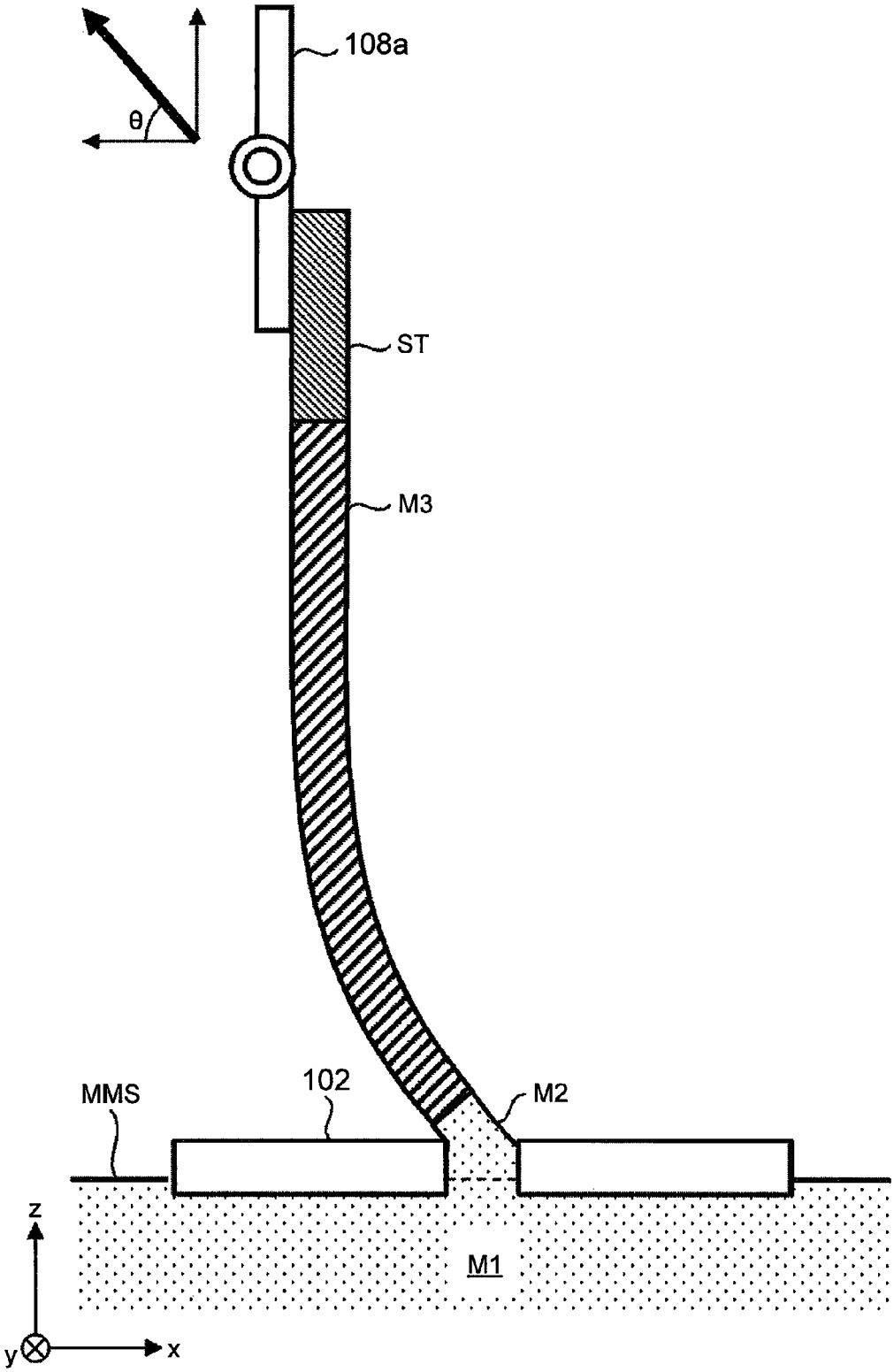
FIG. 5 is a sectional view showing a frame format illustrating the free casting method according to the first example embodiment.

First, the starter ST is lowered by the up-drawing machine 108 via the chuck portion 108*a* so that it passes through the molten metal passage portion 103 of the shape determining member 102, and the tip end portion of the starter ST is dipped into the molten metal M1. As shown in FIG. 4, the chuck portion 108*a* that has the hinge structure is fixed open in a straight line to the starter ST, such that the longitudinal direction of the starter ST is the vertical direction.

Next, the starter ST starts to be drawn vertically upward at a predetermined speed, as shown in FIG. 4. Here, even if the starter ST separates from the molten metal surface MMS, the retained molten metal M2 that follows the starter ST and is drawn up from the molten metal surface MMS by the surface film and surface tension is formed. As shown in FIG. 4, the retained molten metal M2 is formed in the molten metal passage portion 103 of the shape determining member 102. That is, the shape determining member 102 gives the retained molten metal M2 its shape. Here, the starter ST or the casting M3 is cooled by the cooling gas, so the retained molten metal M2 is indirectly cooled, and solidifies progressively from the upper side toward the lower side, thus forming the casting M3.

Next, casting is performed while drawing the molten metal up diagonally in order to form a bent portion. Here, the up-drawing angle θ is gradually reduced as the bending angle of a bent portion increases.

Figure 6:
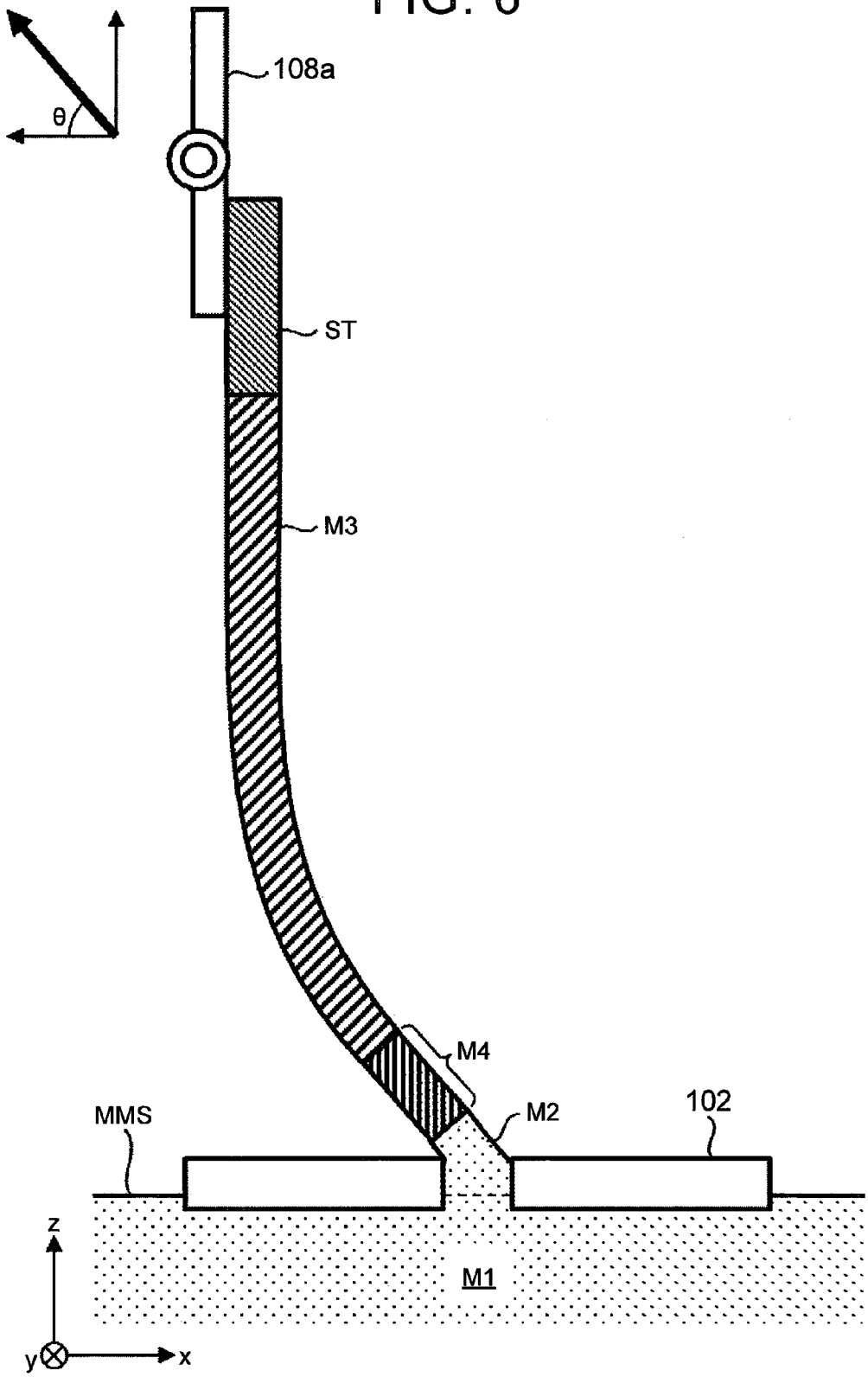
FIG. 6 is a sectional view showing a frame format illustrating the free casting method according to the first example embodiment.

Next, when the up-drawing angle θ reaches a predetermined reference angle, a linear connecting portion M4 is cast adjacent to the casting (a first casting) M3, while maintaining this up-drawing angle θ, as shown in FIG. 6. After casting the connecting portion M4, the connecting portion M4 is separated from the retained molten metal M2 and casting temporarily stops. The connecting portion M4 is a portion that does not form the product, but instead will be dipped into the molten metal M1 and remelted when casting restarts. Here, the connecting portion M4 does not have to be separated from the retained molten metal M2, but separating it makes it easy to change the chucking angle, and is therefore preferable.

Figure 7:
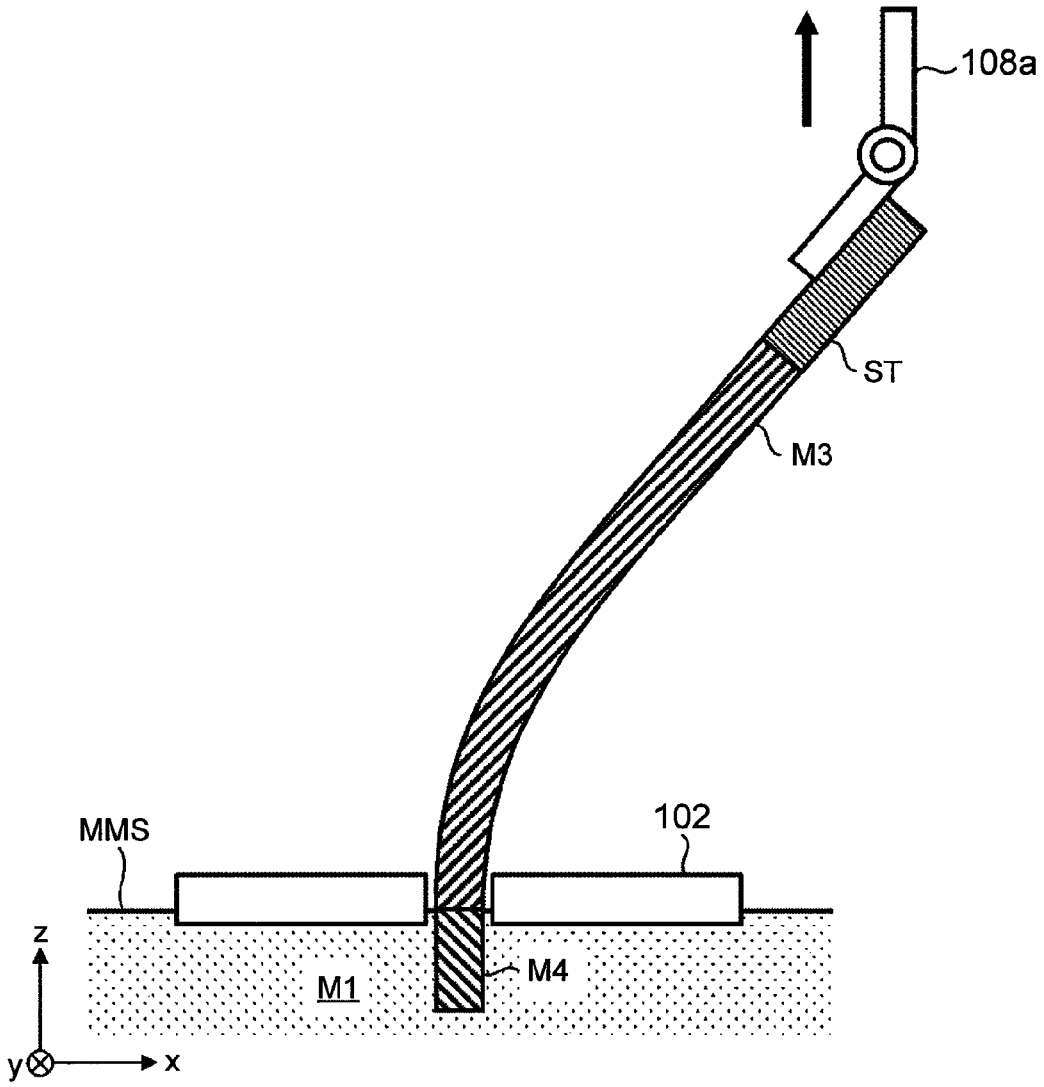
FIG. 7 is a sectional view showing a frame format illustrating the free casting method according to the first example embodiment.

Next, the starter ST is rotated around the y-axis so that the longitudinal direction of the connecting portion M4 is aligned with the vertical direction, by bending the chuck portion 108*a* that has the hinge structure, as shown in FIG. 7. The chuck portion 108*a* is fixed at that bending angle. Then the starter ST is once again lowered by the up-drawing machine 108 via the chuck portion 108*a* so that it passes through the molten metal passage portion 103 of the shape determining member 102, and the connecting portion M4 is dipped into the molten metal M1. After the connecting portion M4 has melted, the starter ST is drawn vertically upward at a predetermined speed and casting restarts. Aligning the longitudinal direction of the connecting portion M4 with the vertical direction (making the longitudinal direction of the connecting portion M4 perpendicular to the molten metal surface MMS) enables the connecting portion M4 to be easily dipped into the molten metal M1. An up-drawing angle θ (a second angle) when casting restarts does not have to be a right angle, and need only be greater than the reference angle. Also, the starter ST may in principle also be rotated about the Y-axis during or after the connecting portion M4 is dipped into the molten metal M1, instead of before the connecting portion M4 is dipped into the molten metal M1.

Figure 8:
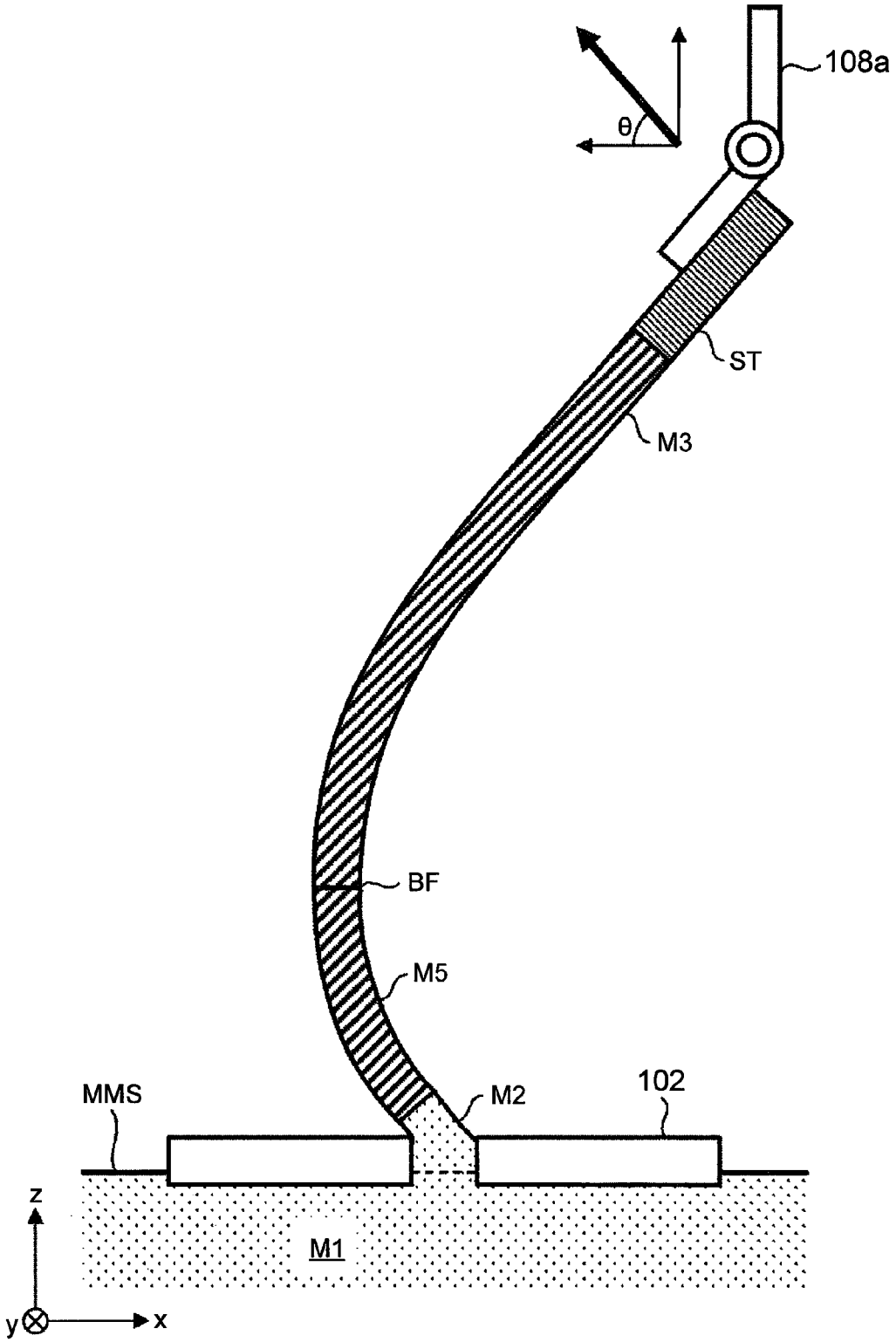
FIG. 8 is a sectional view showing a frame format illustrating the free casting method according to the first example embodiment.

Also, casting is performed while drawing up the molten metal diagonally in order to continuously form the bent portion, as shown in FIG. 8. As a result, a casting with a generally L-shaped longitudinal cross-section that is made from the casting M3 and a casting (a second casting) M5 that are integrally connected together via the joining surface BF is able to be obtained.

As described above, with the free casting method according to the first example embodiment, a casting that was unable to be formed with the free casting method of the related art is able to be formed, by temporarily stopping (interrupting) casting and changing the chucking angle of the starter ST.

Modified Example of the First Example Embodiment

Figure 9:
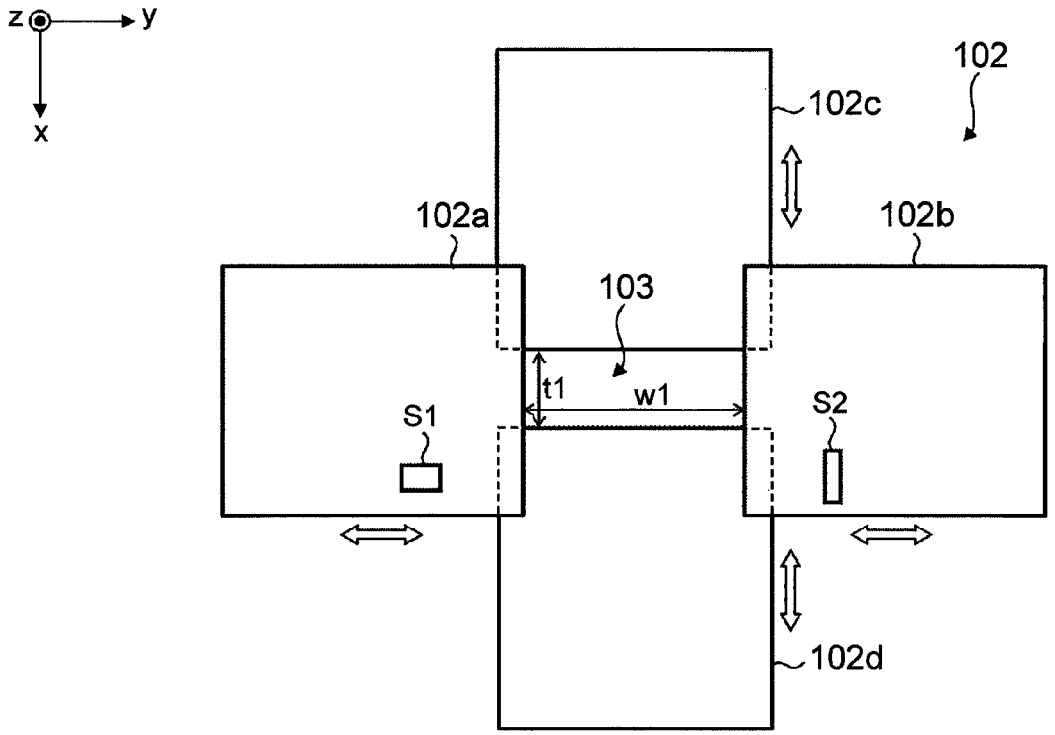
FIG. 9 is a plan view of a shape determining member according to a modified example of the first example embodiment.

Next, a free casting apparatus according to a modified example of the first example embodiment will be described with reference to FIG. 9. FIG. 9 is a plan view of the shape determining member 102 according to the modified example of the first example embodiment. The shape determining member 102 of the first example embodiment shown in FIG. 2 is formed from one plate, so the thickness t1 and width w1 of the molten metal passage portion 103 are fixed. In contrast, the shape determining member 102 according to the modified example of the first example embodiment includes four rectangular shape determining plates 102*a*, 102*b*, 102*c*, and 102*d*, as shown in FIG. 9. That is, the shape determining member 102 according to the modified example of the first example embodiment is divided into a plurality of sections. This kind of structure enables the thickness t1 and width w1 of the molten metal passage portion 103 to be changed. Also, the four rectangular shape determining plates 102*a*, 102*b*, 102*c*, and 102*d* are able to be synchronously moved in the z-axis direction.

As shown in FIG. 9, the shape determining plates 102*a* and 102*b* are arranged facing each other lined up in the x-axis direction. Also, the shape determining plates 102*a* and 102*b* are arranged at the same height in the z-axis direction. The distance between the shape determining plates 102*a* and 102*b* determines the width w1 of the molten metal passage portion 103. Also, the shape determining plates 102*a* and 102*b* are able to move independently in the x-axis direction, so they are able to change the width w1. A laser displacement gauge S1 may be provided on the shape determining plate 102*a*, and a laser reflecting plate S2 may be provided on the shape determining plate 102*b*, as shown in FIG. 9, in order to measure the width w1 of the molten metal passage portion 103.

Also, as shown in FIG. 9, the shape determining plates 102*c* and 102*d* are arranged facing each other lined up in the y-axis direction. Also, the shape determining plates 102*c* and 102*d* are arranged at the same height in the z-axis direction. The distance between the shape determining plates 102*c* and 102*d* determines the thickness t1 of the molten metal passage portion 103. Also, the shape determining plates 102*c* and 102*d* are able to move independently in the x-axis direction, so they are able to change the thickness t1. The shape determining plates 102*a* and 102*b* are arranged contacting upper surfaces of the shape determining plates 102*c* and 102*d*.

The invention is not limited to the example embodiments described above, and may be modified as appropriate without departing from the spirit of the invention.

The invention claimed is:

1. An up-drawing continuous casting method that makes it possible to cast a casting having a bent portion, by drawing up molten metal held in a holding furnace while passing the molten metal through a shape determining member that determines a sectional shape of the cast casting, comprising:

when an angle between an up-drawing direction of the molten metal and an upper surface of the shape determining member, wherein the angle between the up-drawing direction of the molten metal and the upper surface of the shape determining member is within a range from greater than 0° to 90° ($0<\theta\leq 90°$), is reduced to a first angle, drawing up the molten metal while maintaining the angle between the up-drawing direction of the molten metal and the upper surface of the shape determining member at the first angle, and casting a first casting, and then casting a connecting portion adjacent to the cast first casting;

interrupting the drawing up of the molten metal, and dipping the connecting portion into the molten metal while passing the connecting portion through the shape determining member, and melting the connecting portion; and setting the angle between the up-drawing direction of the molten metal and the upper surface of the shape determining member to a second angle that is larger than the first angle, restarting the drawing up of the molten metal and casting a second casting adjacent to the first casting.

2. The up-drawing continuous casting method according to claim 1, wherein the connecting portion is separated from the molten metal when the drawing up of the molten metal is interrupted.

3. The up-drawing continuous casting method according to claim 1, wherein the first angle is greater than 30°.

4. The up-drawing continuous casting method according to claim 1, wherein when dipping the connecting portion into the molten metal, the connecting portion is dipped into the molten metal with a longitudinal direction of the connecting portion being aligned with a direction perpendicular to a molten metal surface of the molten metal.

* * * * *